United States Patent [19]

Clark

[11] 3,953,253

[45] Apr. 27, 1976

[54] ANNEALING OF NITI MARTENSITIC MEMORY ALLOYS AND PRODUCT PRODUCED THEREBY

[75] Inventor: Joel P. Clark, Plainville, Mass.

[73] Assignee: Texas Instruments Incorporated, Dallas, Tex.

[22] Filed: Dec. 21, 1973

[21] Appl. No.: 427,164

[52] U.S. Cl. ..... 148/131; 148/11.5 R; 148/11.5 F; 148/32

[51] Int. Cl.[2] ..... C22F 1/10

[58] Field of Search ..... 148/13, 131, 133, 32, 148/11.5 R, 11.5 F, 2, 3; 75/170

[56] References Cited

UNITED STATES PATENTS

| | | | |
|---|---|---|---|
| 3,351,463 | 11/1967 | Rozner et al. | 75/170 |
| 3,748,197 | 7/1973 | Willson et al. | 148/131 |
| 3,753,792 | 8/1973 | Tyler | 148/131 |

*Primary Examiner*—R. Dean

*Attorney, Agent, or Firm*—James P. McAndrews; John A. Haug; Russell E. Baumann

[57] ABSTRACT

A process for increasing the tensile strength of a martensitic alloy of titanium and nickel and for improving the alloy's ability to retain its original properties during use by stabilizing it against progressive elongation when cycled through successive martensitic transformations. The process comprises maintaining the alloy under a tensile stress of between about 30,000 and 100,000 psi while annealing the alloy at a temperature above a first diffusional phase transformation temperature. The first diffusional phase temperature is the first temperature above the martensitic transformation range at which there is a negative slope in the electrical resistivity versus temperature curve for the alloy. The product of this process has a tensile strength of at least about 175,000 psi and a martensitic elongation activity under stress of at least about 2% and will survive over one million martensitic transformation cycles when placed under sufficient stress that the elongation activity is about 2%.

6 Claims, 4 Drawing Figures

Cycles thru martensitic transformation range with current on for 2 sec and off for 2 sec in each cycle.

Cycles thru martensitic transformation range with current on for 2 sec and off for 2 sec in each cycle.

ANNEALING OF NITI MARTENSITIC MEMORY ALLOYS AND PRODUCT PRODUCED THEREBY

BACKGROUND OF THE INVENTION

This invention relates to the field of martensitic memory alloys and more particularly to a method for annealing martensitic nickel/titanium alloys to substantially improve their tensile strength and to improve the ability of the alloys to retain their original properties during use.

Alloys of nickel and titanium in which the two elements are present in roughly the same molar proportions have been demonstrated to have martensitic memory properties rendering them highly useful in control devices and other services in which temperature actuation is desirable. When placed under stress, an alloy roughly corresponding to the formula NiTi undergoes a martensitic phase transformation in a relatively narrow temperature range with a resultant change in dimension. This dimensional change is negative with respect to temperature. Thus, if an NiTi wire is under tension and is cooled from a temperature above the martensitic transformation range, it will elongate when a critical temperature range is reached. Conversely, when the wire is heated from a temperature below the martensitic range, it will shorten in a temperature range in which the phase transformation is reversed. In such thermal cycling of the wire there is a hysteresis effect in that the major share of the reverse transformation takes place in a temperature range somewhat higher than the temperatures at which the major share of elongation takes place. This phenomenon is illustrated in FIG. 1. The phase transformation associated with elongation is accompanied by the release of heat energy and the reverse transformation is accompanied by an absorption of heat.

Because of their unique property of elongating and reversibly foreshortening over a relatively narrow temperature range, martensitic memory alloys, such as nickel/titanium, have found application as thermostatic elements in control devices and as means for the conversion of heat energy to mechanical energy in devices for performing work. Where the alloy is in the form of a thin wire, for example, it may be very rapidly heated or cooled to cause sharp changes in dimension. The practical utility of such a device is enhanced by the extent of this change in dimension. The martensitic elongation activity of these alloys, defined as the ratio of change in length to length ($\Delta L/L$) expressed as a percentage, ranges as high as 2–6%.

The usefulness of nickel/titanium alloys has been somewhat limited, however, by certain disadvantageous properties. It has been observed, for example, that when a nickel/titanium element is carried through a series of temperature cycles about its martensitic transformation range, it does not fully return to its original dimension but instead progressively elongates or relaxes with each cycle. This phenomenon, which is hereinafter referred to as cyclic creep and which is illustrated in FIG. 2, is a serious obstacle to the practical utility of the nickel/titanium alloy.

A further problem associated with nickel/titanium alloys results from the fact that their martensitic transition temperature is typically near room temperature. As a consequence, the alloy may tend to undergo phase transformations and resultant elongations and foreshortenings due to ambient variations alone. This characteristic presents obvious difficulties in the use of nickel/titanium alloys in control-actuating devices responsive to variables other than ambient temperature.

The transformation temperature of nickel-titanium alloys can be altered by the amount of stress under which the alloys are placed. Thus, for example, if a nickel/titanium wire is placed under relatively high tension, the temperatures at which the phase transformation takes place may be increased by as much as 70°C. However, the feasibility of realizing such substantial increases in the operating temperature of a nickel/titanium device may be seriously limited by the tensile strength of the alloy itself. Even when the stress is not sufficient to cause the alloy to yield or fail, moreover, NiTi alloys are subject to creep at elevated temperature. This creep, of course, adversely effects dimensional stability independently of the cyclic creep or progressive elongation due to thermal cycling.

A practical need has thus existed for methods to stabilize martensitic nickel/titanium alloys against progressive elongation or relaxation, and to increase their tensile strength and cyclic creep resistance so that they may be placed under high stress and used in circumstances where they respond at significantly elevated temperatures. Efforts have been made in the art to meet each of these objectives. Thus, for example, Willson et al. U.S. Pat. No. 3,652,969 describes a method in which the nickel/titanium alloy is repeatedly cycled through its critical temperature range while it is maintained under stress substantially greater than the stress to be applied in an anticipated practical application. Although thus useful for improving the repeatability of a nickel/titanium alloy device and preventing relaxation during use, the method of Willson et al. is not directed towards any improvement in the tensile strength.

Wang U.S. Pat. No. 3,594,239 describes a process which is also directed to minimizing the relaxation of martensitic memory alloys during use. This process involves annealing the alloy at 650°–700°C. and slowly cooling it to a temperature below that at which it undergoes thermal cycling. Wang also contemplates a further step of thermal cycling between the upper critical temperature limit and the lower critical temperature limit as a means of increasing the maximum resistivity value in the martensitic range, but does not suggest the application of stress during this step as taught by Willson et al. Like Willson et al., Wang is primarily concerned with avoiding the relaxation resulting from thermal cycling and, although he does recognize the value of applying stress to increase the temperature at which martensitic transformation takes place, Wang is not concerned with increasing the tensile strength to maximize the stress that can be applied.

Others, as described for example in Rozner and Buehler U.S. Pat. No. 3,351,463, have been concerned with improving the mechanical strength of nickel/titanium alloys but not with the problem of progressive elongation due to thermal cycling. The progress of Rozner and Buehler involves working the alloy below its critical temperature, typically by the methods used in shaping and fabrication. Working is carried out after annealing in this process with a consequent materially adverse effect on the elongation activity of the alloy.

SUMMARY OF THE INVENTION

It is thus an object of the present invention to provide an improved method for treating nickel-titanium martensitic memory alloys both to increase their tensile strength and to reduce their tendency to relax due to thermal cycling. It is a further object of the present invention to provide such a method which improves the high temperature creep resistance of nickel/titanium alloys. An additional object of the present invention is to provide a martensitic nickel/titanium memory alloy having a high resistance to fatigue failure. Other objects and features will be in part apparent and in part pointed out hereinafter.

Briefly, therefore, the present invention is directed to a process for increasing the tensile strength of a martensitic memory alloy of nickel and titanium and improving the alloy's cyclic creep resistance by stabilizing it against progressive elongation when cycled through successive martensitic transformations. The process comprises maintaining the alloy under a tensile stress of between about 30,000 and about 100,000 psi while annealing the alloy. The annealing temperature is above a temperature defined as a first diffusional phase transformation temperature. The first diffusional phase transformation temperature is the first temperature above the martensitic transformation range in which there is a negative slope in the electrical resistivity versus temperature curve for the alloy.

The invention is further directed to a martensitic memory alloy of nickel and titanium. This alloy has a tensile strength of at least about 175,000 psi and a martensitic elongation activity of at least about 2%. It resists fatigue failure for at least a million cycles through its martensitic transformation range when under sufficient stress that its elongation activity is about 2%.

DESCRIPTION OF THE PREFERRED EMBODIMENTS

In accordance with the present invention, it has now been discovered that the tensile strength of a martensitic nickel/titanium alloy can be substantially increased by annealing the alloy under tension at a temperature which is controlled with respect to the first phase transformation occurring in said alloy above the martensitic transformation range. Substantial alignment of both grain and substructure are realized by this tension-annealing process. Ultimate tensile strength of nickel/titanium alloys containing between about 50% and about 58% by weight nickel is increased to the range of 175,000 to 325,000 psi by the annealing process of this invention.

It is important that annealing be carried out at a temperature above the first temperature above the martensitic transformation range at which a diffusional phase transformation takes place. The transformation occurring at such temperature is believed to be an order-disorder type transition, though this has not been conclusively established. Regardless of the exact nature of this transition, however, the temperature at which it takes place has been found to constitute a lower limit for the annealing temperature in the process of the invention.

Perferably, annealing is carried out at a temperature in the range of about 50°C. above the first diffusional phase transformation temperature. As the annealing temperature is increased above the phase transformation temperature, the annealed alloy tends to exhibit a higher martensitic transition temperature, a result which is often desirable. On the other hand, the ultimate strength of the annealed alloy tends to decrease somewhat as the annealing temperature is increased. Fifty degrees centigrade above the first diffusional phase transformation temperature is considered to provide an optimum balance between these two effects. There is, however, no criticality in the temperature and a wide range of temperatures above the first diffusional phase transformation temperature can be utilized with quite satisfactory results.

Figure 1:
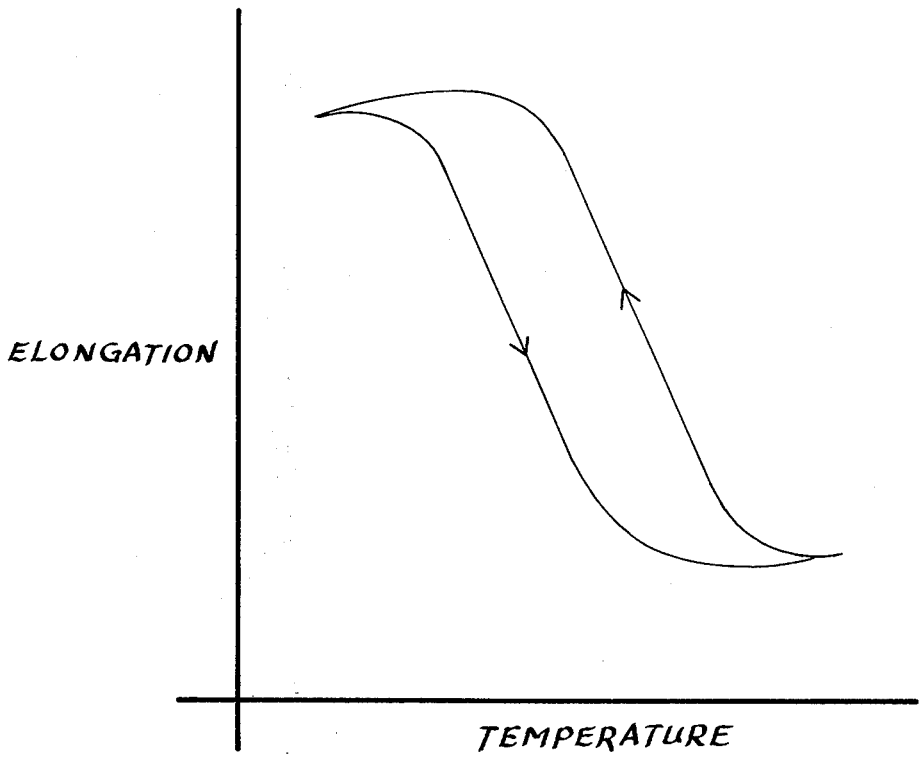
FIG. 1 is a plot of elongation versus temperature illustrating the operation of a martensitic memory alloy.
Figure 2:
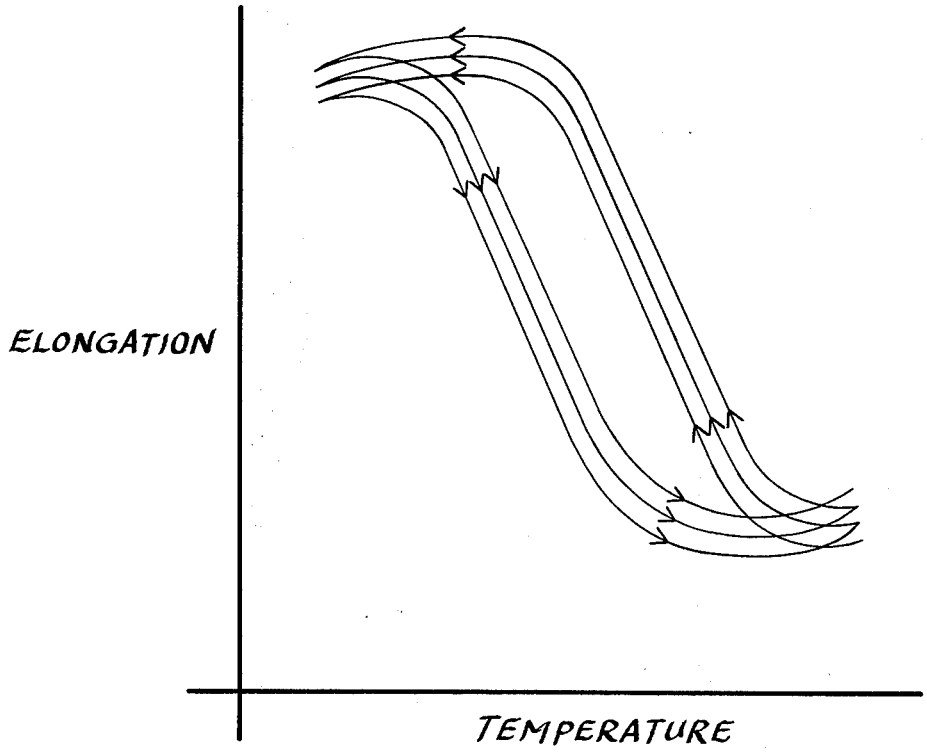
FIG. 2 is a plot similar to FIG. 1 showing progressive elongation of a martensitic memory alloy due to repeated cycling through the martensitic transformation range.
Figure 3:
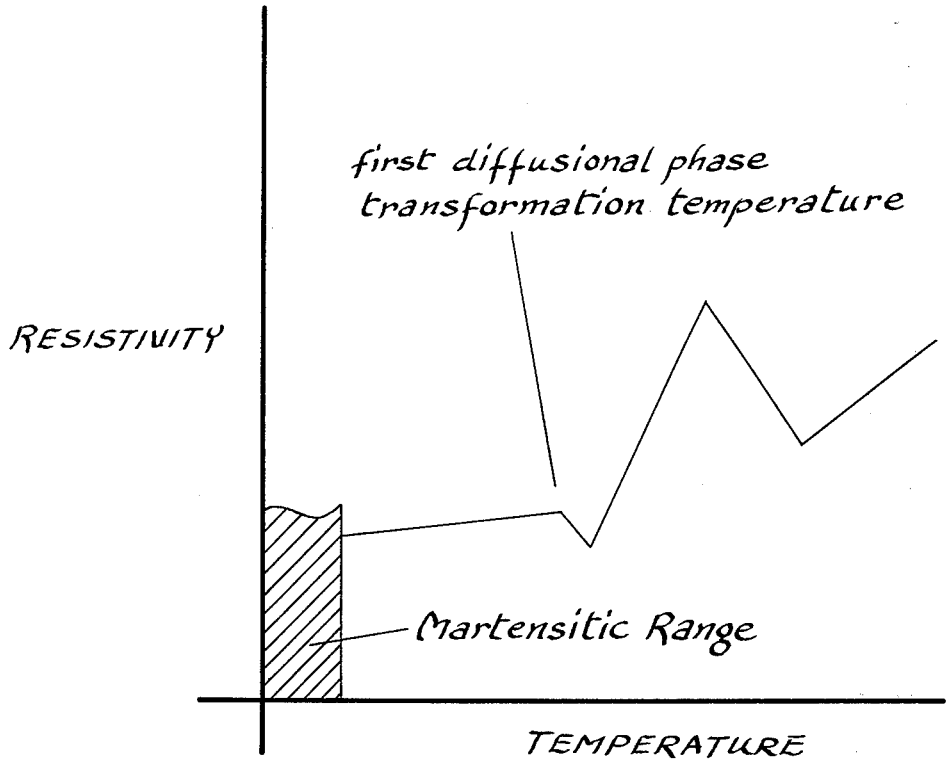
FIG. 3 is a plot of electrical resistivity versus temperature indicating the first diffusional phase transformation temperature above which annealing is carried out in the process of the invention.

The temperature at which the reference diffusional phase transformation takes place varies within a range of about 300°–500°C., depending upon the composition of the nickel/titanium alloy. The reference temperature for a particular alloy may be readily determined, however, from the relationship between electrical resistivity of the alloy and temperature in the range of temperatures above the martensitic transformation range. Electrical resistivity is generally a gradually increasing function of temperature in the range immediately above the martensitic transformation range. However, at the temperature where the first diffusional phase transformation commences, there is a sharp substantially discontinuous change from slightly positive to negative in the slope of the resistivity curve. Above the first diffusional phase transformation range, the resistivity versus temperature slope again becomes positive until a second diffusional phase transformation occurs at about 550°–700°C. This phenomenon is illustrated in FIG. 3.

Because of the high sensitivity of the first diffusional phase transformation temperature to the exact composition of the alloy, it is advisable to directly determine this temperature by developing a resistivity versus temperature curve for each alloy to be annealed. Since it is often inconvenient to measure the resistivity of an alloy specimen when the specimen is at elevated temperature, it may be desirable to develop relevant aspects of the resistivity versus temperature curve by measuring the resistivity of specimens which have been raised to one of a series of temperatures in the range of interest and then quenched to 0°C., for example, immediately before measurement of resistivity. It has been found that the quenched specimen retains properties for a sufficient period of time after quenching to permit determination of the first diffusional phase transformation temperature.

During the annealing process, the alloy is subjected to tension in the range of about 30,000 to about 100,000 psi. The amount of tension is not critical within this range, though it has been observed that an optimum may exist which varies with the composition of the alloy. The optimum for a particular alloy may be determined by straightforward experimentation. As indicated, however, satisfactory results are obtained at essentially any tension within the 30,000 to 100,000 psi range.

The process of the invention is conveniently carried out by passing a nickel/titanium alloy wire continuously through the hot zone of a furnace while subjecting the wire to tension in the aforesaid range. Furnace residence time required to anneal and strengthen the wire varies with wire diameter. Fully satisfactory results are obtained, for example, when 2 mil wire is passed through a 2-ft. long hot zone at a rate of 2 ft./min. The wire emanating from the furnace is quenched in air.

Before it is put into use, the annealed alloy is preferably preconditioned by cycling it repeatedly through its martensitic range under conditions more severe than those anticipated in service. Thus, both the stress applied and the maximum temperature utilized during preconditioning should exceed the stress and temperature to which the alloy will be subjected in use.

The product of the invention is a high tensile strength nickel/titanium alloy in which both the grain and the substructure is aligned. Ultimate tensile strength of the product is in the range of 175,000 to 325,000 psi, thus allowing the product to be placed under high stress to displace its martensitic transformation to a temperature well above room temperature. Even at high stresses, in the range from 100,000 to 200,000 psi or higher, moreover, the product alloy retains a martensitic elongation activity of at least about 2%. The product of the invention is also resistant to fatigue failure, surviving one million or more cycles when maintained under sufficient stress that the elongation activity is about 2%. Lesser, but still significant, fatigue resistance is exhibited by these alloys when the stress is such that elongation activity is significantly greater than 2%.

The product of the invention is also stabilized against progressive elongation or relaxation due to thermal cycling, and is additionally highly creep resistant. The latter two factors are of substantial practical importance since dimensional stability is essential for a martensitic alloy element utilized in a commercial control or work-peforming device. As a result of its combined properties of high tensile strength, fatigue resistance and cyclic creep resistance, the alloy of this invention may be successfully utilized in a commercial device where its martensitic transformation temperature is as high as 120°C.

The following examples illustrate the invention.

Example 1

Resistivity tests were conducted on a 2 mil diameter wire constituted by a nickel/titanium alloy containing 54.3% nickel by weight. The results of these tests indicated that the onset of the first diffusional phase transformation above the martensitic transformation range occurred at approximately 375°C.

The wire was annealed in a tube furnace heated by electrical resistance elements and including a central glass tube through which the wire was passed. Containment of the wire in the tube prevented accidental contact of the wire with the resistance elements. The wire was passed through the furnace at a rate of approximately 2 ft./min. under a tension of 35,000 psi while it was annealed at approximately 425°C. After quenching in air, the wire was subjected to tensile tests and found to have an ultimate tensile strength of approximately 200,000 psi.

Example 2

Figure 4:
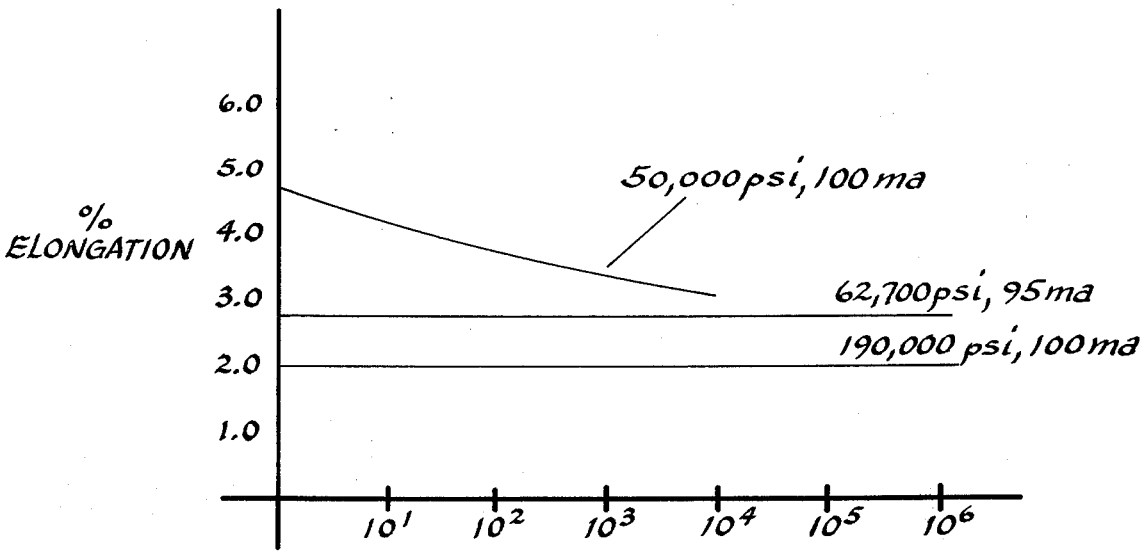
FIG. 4 is a plot of elongation activity versus number of cycles through the martensitic transformation range for an alloy subjected to various combinations of stress and internal resistance heating in an ambient temperature of 25°C.

A 2 mil diameter wire constituted by a nickel/titanium alloy containing 54.8% by weight nickel was tension-annealed in a manner similar to that described in Example 1. Specimens of this wire were then placed under tension and repeatedly cycled through the martensitic transformation range by passing current therethrough on a periodic basis. In each cycle, the current was on for 2 seconds and off for 2 seconds. The percentage elongation of each specimen was measured throughout the thermocycling tests in an ambient of 25°C. The results of these tests are set forth in the table below and are shown graphically in FIG. 4:

Table I

Thermocycling Tests on Tension Annealed* 2 mil Diameter 54.8% Nickel/45.2% Titanium Alloy Wire

| Tension | Current | Initial Elongation | Elongation at End of Test | Number of Cycles to to Failure |
|---|---|---|---|---|
| 50,000 psi | 100 mA. | 4.5% | 2.8% | $10^4$ |
| 62,700 psi | 95 mA. | 2.7% | 2.7% | $10^6$** |
| 190,000 psi | 100 mA. | 2.0% | 2.0% | $10^6$** |

*35,000 psi at 450°C.
**did not fail
Note: Tests conducted in an ambient of 25°C.

In view of the above, it will be seen that the several objects of the invention are achieved and other advantageous results attained.

As various changes could be made in the above processes and products without departing from the scope of the invention, it is intended that all matter contained in the above description or shown in the accompanying drawings shall be interpreted as illustrative and not in a limiting sense.

What is claimed is:

1. A process for increasing the tensile strength of a selected martensitic alloy of titanium and nickel and improving the alloy's cyclic creep resistance by stabilizing it against progressive elongation when cycled through successive martensitic transformations, said alloy having a martensitic transformation temperature range and a first diffusional phase transformation temperature constituting the first temperature above said martensitic transformation range at which there is a negative slope in the electrical resistivity versus temperature curve for said alloy, said first diffusional phase transformation temperature being in the range from about 300° to 500°C., the process comprising maintaining said alloy under a tensile stress of between about 30,000 and 100,000 psi while heating the alloy at a temperature above said first diffusional phase transformation temperature to anneal said alloy for substantially increasing the tensile strength thereof.

2. A process as set forth in claim 1 wherein the annealing temperature is on the order of 50°C. above said diffusional phase transformation temperature.

3. A process as set forth in claim 1 wherein said alloy contains between about 50 and about 58% by weight nickel and the balance is essentially titanium.

4. A process as set forth in claim 1 wherein said alloy is in the form of a wire and said wire is passed continuously through a hot zone where it is annealed while being maintained under said tensile stress.

5. A process as set forth in claim 4 wherein said wire is quenched as it leaves the hot zone.

6. A high strength martensitic alloy of nickel and titanium in annealed condition having a tensile strength greater than about 175,000 psi and a martensitic elongation activity of at least about 2.0% even under tension greater than 100,000 psi, said high strength alloy being resistant to fatigue for at least one million cycles through its martensitic transformation range when under sufficient stress that its elongation activity is about 2%, said high strength alloy being formed from a selected martensitic starting alloy of titanium and nickel having a martensitic transformation temperature range and a first diffusional phase transformation temperature constituting the first temperature above said martensitic transformation temperature range at which there is a negative slope in the electrical resistivity versus temperature curve for said starting alloy, said first diffusional phase transformation temperature for said starting alloy being in the range from about 300° to 500°C., said high strength alloy being formed by maintaining said starting alloy under a tensile stress of between about 30,000 and 100,000 psi while heating said starting alloy at a temperature above said first diffusional phase transformation temperature of said starting alloy to anneal said alloy for substantially increasing the tensile strength thereof.

* * * * *